US010607826B2

(12) United States Patent
Boock et al.

(10) Patent No.: US 10,607,826 B2
(45) Date of Patent: Mar. 31, 2020

(54) ATMOSPHERIC PRESSURE ION GUIDE

(71) Applicant: THE UNIVERSITY OF FLORIDA RESEARCH FOUNDATION, INC., Gainesville, FL (US)

(72) Inventors: Jared J. Boock, Gainesville, FL (US); Joaquin Jesus Casanova, Gainesville, FL (US); Richard A. Yost, Gainesville, FL (US); Brian Smith, Ocala, FL (US)

(73) Assignee: University of Florida Research Foundation, Incorporated, Gainesville, FL (US)

( * ) Notice: Subject to any disclaimer, the term of this patent is extended or adjusted under 35 U.S.C. 154(b) by 34 days.

(21) Appl. No.: 15/747,159

(22) PCT Filed: Jul. 28, 2016

(86) PCT No.: PCT/US2016/044447
§ 371 (c)(1),
(2) Date: Jan. 24, 2018

(87) PCT Pub. No.: WO2017/019852
PCT Pub. Date: Feb. 2, 2017

(65) Prior Publication Data

US 2018/0233342 A1 Aug. 16, 2018

Related U.S. Application Data

(60) Provisional application No. 62/197,733, filed on Jul. 28, 2015.

(51) Int. Cl.
*H01J 49/00* (2006.01)
*H01J 49/06* (2006.01)

(52) U.S. Cl.
CPC ..... *H01J 49/066* (2013.01); *H01J 49/0031* (2013.01)

(58) Field of Classification Search
CPC ..... H01J 49/065; H01J 49/066
See application file for complete search history.

(56) References Cited

U.S. PATENT DOCUMENTS 5,206,506 A * 4/1993 Kirchner ..... G21K 1/003 250/281
6,107,628 A 8/2000 Smith et al.
(Continued)

OTHER PUBLICATIONS

International Search Report for PCT/US2016/044447 dated Oct. 28, 2016.

*Primary Examiner* — Nicole M Ippolito
*Assistant Examiner* — Sean M Luck
(74) *Attorney, Agent, or Firm* — Thomas Horstemeyer, LLP

(57) ABSTRACT

Atmospheric pressure ion guides are provided. The atmospheric pressure ion guides can include a multi-ring electrode structure connecting a larger opening to a smaller opening and having a series of ring electrodes with decreasing diameter and voltage going from the larger opening to the smaller opening. The electrodes can be made from stainless steel or other suitable conductive material. The multi-ring electrode structure can be contained in a housing, such as a housing made from polyetheretherketone or other suitable thermosetting polymer. The atmospheric pressure ion guide can focus ions from an ion source for use with ion detection devices such as an ion mobility spectrometer or a mass spectrometer. Methods of using the atmospheric pressure ion guides are provided, for example to focus a plurality of ions to be injected into an ion detection device. The atmospheric pressure ion guides can increase the signal intensity of the ion detection device.

21 Claims, 4 Drawing Sheets

(56) References Cited

U.S. PATENT DOCUMENTS 7,064,321 B2 * 6/2006 Franzen ..... H01J 49/066 250/281
7,514,676 B1 * 4/2009 Page ..... G01N 27/622 250/281
7,838,826 B1 * 11/2010 Park ..... G01N 27/622 250/281
8,222,597 B2 * 7/2012 Kim ..... H01J 49/066 250/292
8,835,839 B1 * 9/2014 Anderson ..... H01J 49/06 250/290
8,941,055 B2 * 1/2015 Park ..... G01N 27/622 250/282
9,063,086 B1 * 6/2015 Garimella ..... G01N 27/622
2004/0031920 A1 * 2/2004 Giles ..... G01N 27/622 250/287
2004/0245452 A1 * 12/2004 Bateman ..... G01N 27/622 250/287
2007/0034810 A1 * 2/2007 Hoyes ..... H01J 49/427 250/396 R
2008/0191130 A1 * 8/2008 Bateman ..... H01J 49/027 250/283
2009/0050801 A1 * 2/2009 Fedorov ..... H01J 49/066 250/288
2009/0065692 A1 * 3/2009 Javahery ..... H01J 49/0045 250/290
2009/0302209 A1 * 12/2009 Green ..... H01J 49/065 250/282
2010/0038533 A1 2/2010 Makaraov et al.
2010/0301227 A1 * 12/2010 Muntean ..... H01J 49/063 250/396 R
2011/0095175 A1 * 4/2011 Bateman ..... G01N 27/624 250/282
2011/0248157 A1 * 10/2011 Sugiyama ..... H01J 49/063 250/282
2012/0273670 A1 * 11/2012 Park ..... G01N 27/626 250/282
2013/0187044 A1 * 7/2013 Ding ..... H01J 49/065 250/292
2014/0339414 A1 11/2014 Loboda
2015/0206731 A1 7/2015 Zhang et al.
2015/0276676 A1 * 10/2015 Jiang ..... G01N 27/622 250/282
2015/0364309 A1 * 12/2015 Welkie ..... H01J 49/062 250/282
2016/0260594 A1 * 9/2016 Hendricks ..... H01J 49/0022

* cited by examiner

ATMOSPHERIC PRESSURE ION GUIDE

CROSS-REFERENCE TO RELATED APPLICATIONS

This application is the 35 U.S.C. § 371 national stage application of PCT Application No. PCT/2016/044447, filed Jul. 28, 2016, where the PCT claims priority to, and the benefit of, U.S. provisional application entitled "ATMOSPHERIC PRESSURE ION GUIDE" having Ser. No. 62/197,733, filed Jul. 28, 2015, both of which are herein incorporated by reference in their entireties.

BACKGROUND

Atmospheric pressure ion sources coupled to mass spectrometers often produce random noise spikes or significant ion loss which can severely limit the signal-to-noise ratio in the mass spectra. Ion transfer tubes or capillaries are well known in the field of mass spectrometry for the transport of ions between an ionization chamber maintained at or near atmospheric pressure and a second chamber maintained at reduced pressure. Generally described, an ion transfer channel typically takes the form of an elongated narrow tube (capillary) having an inlet end open to the ionization chamber and an outlet end open to the second chamber.

Several ion funneling solutions have been proposed in the art. For example, an ion funnel for operation under vacuum conditions after an ion transfer capillary was described in U.S. Pat. No. 6,107,628. Unfortunately, most ion funnel devices only operate effectively up to gas pressures of approximately 40 mbar. While some of these approaches may be partially successful for reducing ion loss and/or alleviating adverse effects arising from ion collisions with the tube wall, the focusing at atmospheric pressure with minimal noise remains a challenge.

There remains a need for atmospheric pressure ion guides capable of focusing ions for a variety of ion detection devices and from a variety of ion sources.

SUMMARY

Atmospheric pressure ion guides are provided having a larger opening; a smaller opening smaller in diameter than the larger opening; and a multi-ring electrode structure connecting the larger opening to the smaller opening and having a series of ring electrodes decreasing in diameter going from the larger opening to the smaller opening. The diameter of the ring electrodes in the series can decrease exponentially going from the larger opening to the smaller opening. The largest ring electrode in the series can have a diameter of 20 mm to 80 mm, while the smallest ring electrode in the series can have a diameter of 2 mm to 20 mm.

Each ring electrode can have a voltage and the voltage of each electrode can decrease going from the larger opening to the smaller opening. The voltage of each electrode in the series can decrease exponentially going from the larger opening to the smaller opening. The largest ring electrode in the series can have a voltage of 3000 V to 6000 V, while the smallest ring electrode in the series can have a voltage of 400 V to 800 V. The voltage on each electrode can be a DC voltage.

The ring electrodes can include a material such as stainless steel, brass, copper, platinum, titanium, tantalum, and alloys thereof. The series of ring electrodes can have from 12 rings to 25 rings. The atmospheric pressure ion guide can further contain one or more additional rings, such as for allowing placement of an ion source at the entrance of the ion guide. The additional rings can be between the multi-ring electrode structure and the first larger opening.

The atmospheric pressure ion guide can include a housing having the first larger opening and the second smaller opening and containing the multi-ring electrode structure. The housing can be made from a thermosetting polymer material such as polyethylene, polymethylmethacrylate, polyurethane, polysulfone, polyetherimide, polyimide, ultra-high molecular weight polyethylene (UHMWPE), cross-linked UHMWPE and members of the polyaryletherketone (PAEK) family such as polyetheretherketone (PEEK), carbon-reinforced PEEK, and polyetherketoneketone (PEKK).

Methods of focusing a plurality of ions from an ion source are provided. The methods can include injecting the ions at a first density at or near the larger opening of an atmospheric pressure ion guide, where the ions travel along the length of the multi-electrode ion structure and exit through the smaller opening with a second density larger than the first density. The pressure within the atmospheric pressure ion guide can be, for example, about 0.2 atm to 2 atm. The ions can have a first velocity when injected at or near the larger opening and a second velocity when exiting through the smaller opening, and the second velocity can differ from the first velocity by less than 10%.

Methods of injecting a plurality of ions from an ion source into an ion detection device are also provided. The methods can include focusing the ions according to the method methods described herein and injecting the ions exiting through the smaller opening into the ion detection device. The ions exiting the smaller opening can be injected into the ion detection device through an ion transfer assembly. The ion detection device can be an ion mobility spectrometer, a mass spectrometer, or a combination thereof. The ion detection device can produce a signal that is 5-20 times larger than a second signal produced by the same ion detection device and using the otherwise same method except for not focusing the ions prior to injection into the ion detection device. The signal can be at least 5 times larger than a signal obtained under the otherwise same conditions except without applying a voltage to the atmospheric pressure ion guide.

BRIEF DESCRIPTION OF THE DRAWINGS

Further aspects of the present disclosure will be readily appreciated upon review of the detailed description of its various embodiments, described below, when taken in conjunction with the accompanying drawings.

DETAILED DESCRIPTION

Figure 1:
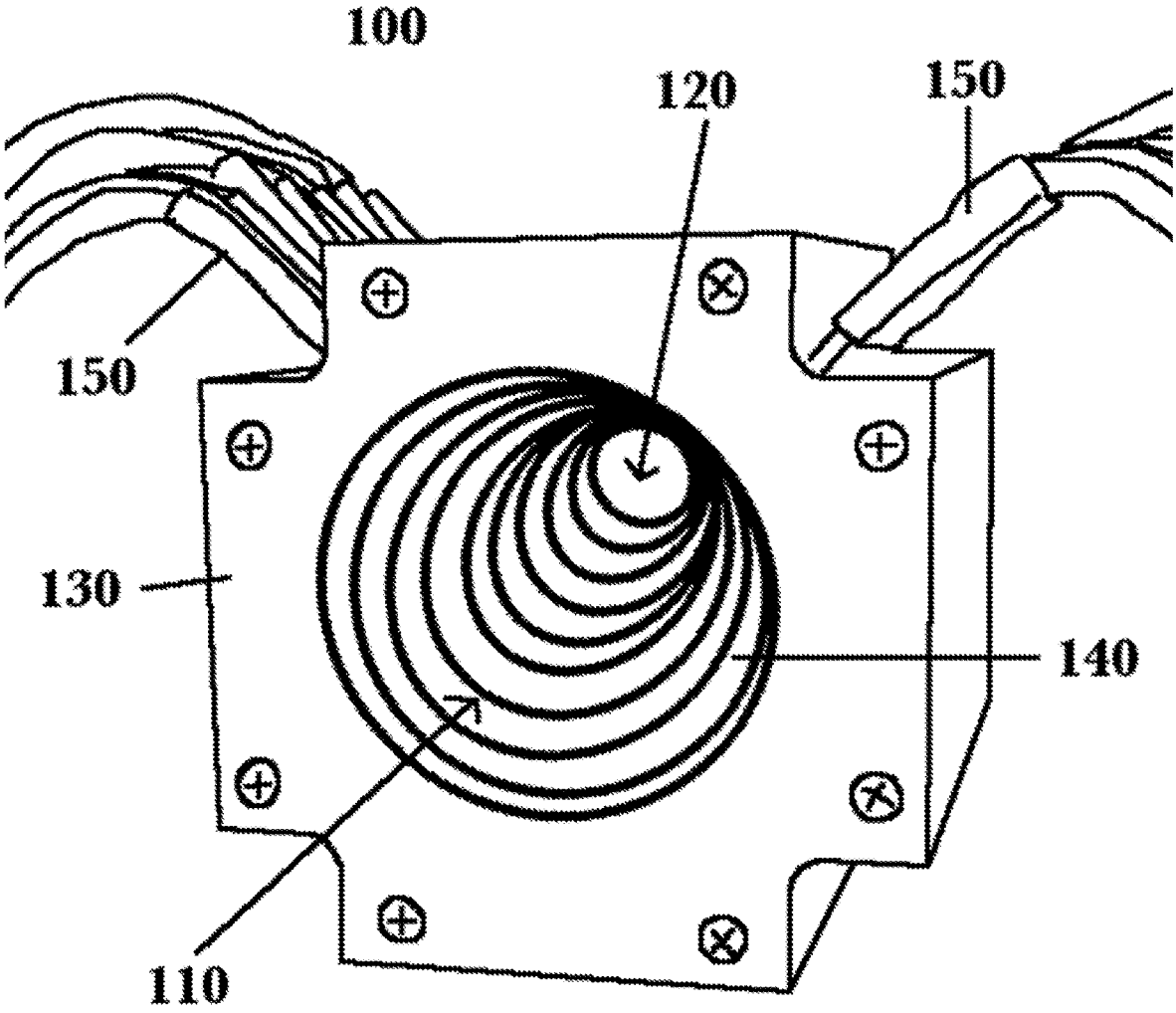
FIG. 1 is a diagram of one embodiment of an atmospheric pressure ion guide having a multi-ring electrode structure to focus the ions.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'".

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Atmospheric Pressure Ion Guide

Atmospheric pressure ion guides are provided. The atmospheric pressure ion guide can include a larger opening, a smaller opening, and a multi-ring electrode structure connecting the larger opening and the smaller opening. The multi-ring electrode structure can have a series of ring electrodes decreasing in diameter going from the larger opening to the smaller opening. There can be a voltage on each of the electrodes that decreases going from the larger opening to the smaller opening. The decrease of the diameter and/or the voltage of each ring electrode can decrease exponentially. The multi-ring electrode structure can be used at around atmospheric pressure and can focus ions from an ion source for use with an ion detection device. The atmospheric pressure ion guide can include a housing having the openings and containing the multi-ring electrode structure.

The atmospheric pressure ion guide can be made from a variety of materials that are readily available to the skilled artisan. For example, the ring electrodes can be made from any suitable electrode material capable of withstanding the voltages. In some embodiments, the ring electrodes are made from stainless steel, brass, copper, platinum, titanium, tantalum, or alloys thereof. The housing can be made from any suitable non-conductive material. For example, the housing material can be made from a thermosetting polymer such as polyethylene, polymethylmethacrylate, polyurethane, polysulfone, polyetherimide, polyimide, ultra-high molecular weight polyethylene (UHMWPE), cross-linked UHMWPE and members of the polyaryletherketone (PAEK) family, including polyetheretherketone (PEEK), carbon-reinforced PEEK, and polyetherketoneketone (PEKK).

One embodiment of an atmospheric pressure ion guide 100 is depicted in FIG. 1. The atmospheric pressure ion guide 100 includes a larger opening 110 and a smaller opening 120 and a multi-ring electrode structure 140 connecting the larger opening 110 and the smaller opening 120. The atmospheric pressure ion guide 100 can include a housing 130 containing the multi-ring electrode structure 140. A series of high voltage leads 150 can be attached to the multi-ring electrode structure 140 and to a power source (not pictured) that controls the voltage on the electrodes in the multi-ring electrode structure 140. The voltage on each of the electrodes can be precisely controlled so that the voltage decreases along the multi-ring electrode structure 140 going from the larger opening 110 to the smaller opening 120. Likewise, the diameter of the multi-ring electrode structure 140 can decrease going from the first larger opening 110 to the second smaller opening 120. In some embodiments one or both of the voltage and the diameter of the multi-ring electrode structure 140 decreases exponentially in going from the first larger opening 110 to the second smaller opening 120.

Figure 2:
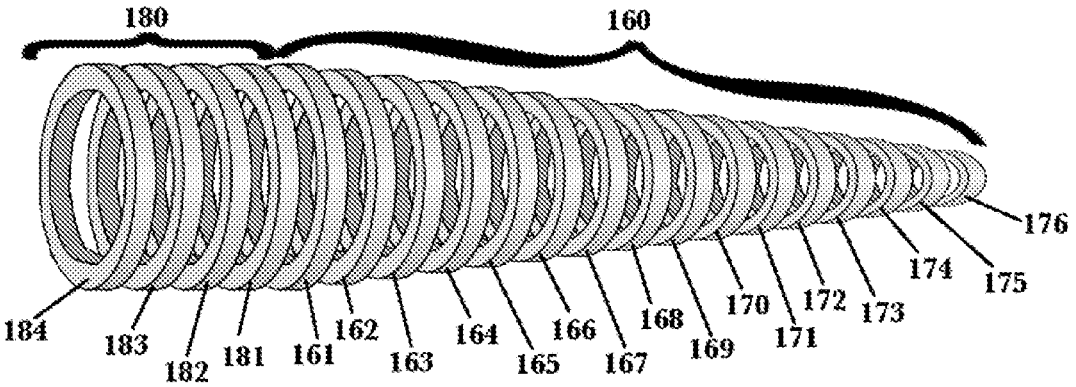
FIG. 2 is a diagram of one embodiment of a multi-ring electrode structure having twenty rings.
Figure 3:
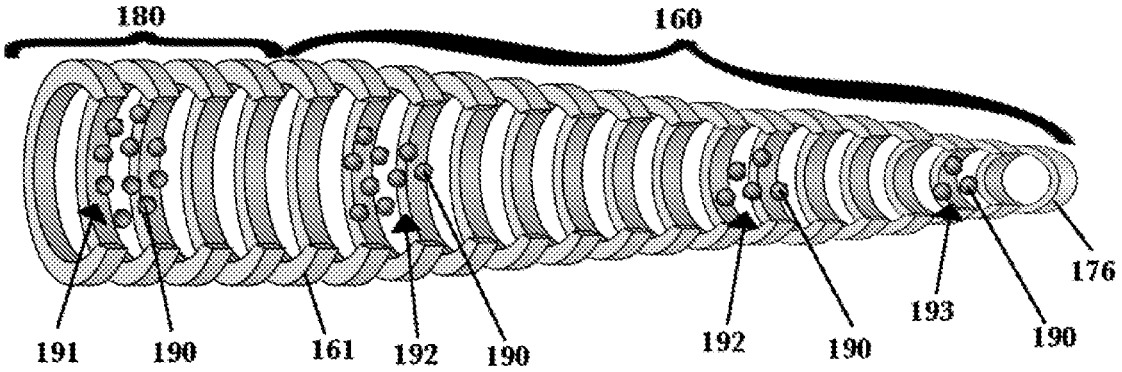
FIG. 3 is a diagram showing a cross-sectional view of one embodiment of a multi-ring electrode structure having twenty rings and depicting the focusing of ions within the multi-ring electrode structure.
Figure 4:
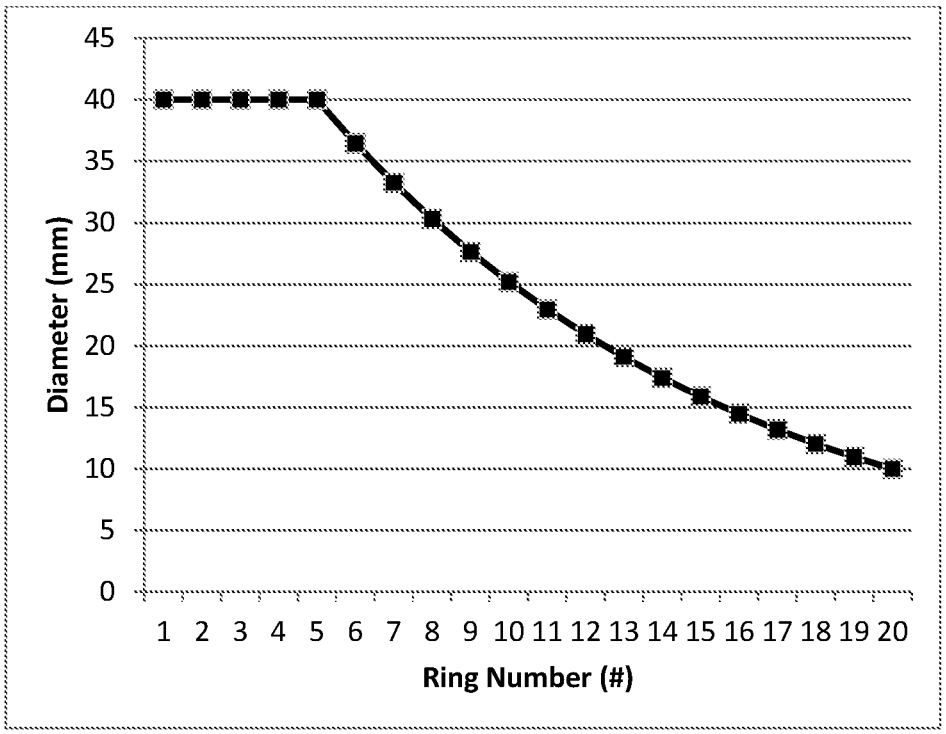
FIG. 4 is a graph of the ring diameters in an exemplary atmospheric pressure ion guide having a multi-ring electrode structure with twenty rings. The diameters (mm) are plotted as a function of the ring number going from the larger opening to the smaller opening.

FIG. 2 and FIG. 3 depict one embodiment of the multi-ring electrode structure 140 having a series of ring electrodes 160 decreasing in diameter going from the larger opening 110 to the smaller opening 120. The series of ring electrodes 160 can include any number of ring electrodes from 2 to about 30 or more, for example 3 to 30, 4 to 30, 5 to 30, 5 to 28, 6 to 28, 8 to 28, 10 to 28, 10 to 26, 10 to 24, 10 to 22, 12 to 20, 14 to 18, or about 16 ring electrodes. The series of ring electrodes 160 can include a first largest ring electrode 161 and a last smallest ring electrode 176. The first largest ring electrode 161 can have a diameter of about 20 mm to 200 mm, about 20 mm to 150 mm, about 20 mm to 120 mm, about 20 mm to 100 mm, about 20 mm to 80 mm, about 30 mm to 80 mm, about 30 mm to 60 mm, or about 40 mm. The last smallest ring electrode 176 can have a diameter of about 2 mm to 40 mm, about 2 mm to 30 mm, about 2 mm to 20 mm, about 4 mm to 20 mm, about 5 mm to 15 mm, or about 10 mm. In some embodiments, each of the rings in the multi-ring electrode structure 140 can have a diameter according to FIG. 4. Each of the electrodes in the series of ring electrodes can be separated from an electrode immediately adjacent by any distance, but in some embodiments the distance will be about 2 mm to 50 mm, about 2 mm to 30 mm, about 2 mm to 20 mm, about 4 mm to 20 mm, about 8 mm to 20 mm, about 8 mm to 16 mm, about 10 mm to 14 mm, or about 12.7 mm. The electrodes in the series can be separated from adjacent electrodes by an insulating material. The insulating material can be part of the housing 130.

The ring electrodes in the series of ring electrodes 160 can decrease in diameter going from the first largest ring electrode 161 to the last smallest ring electrode 176. In some embodiments the decrease in diameter is exponential. In some embodiments, in the series of ring electrodes 160 the first largest electrode 161 has a diameter of about 40 mm, the second electrode 162 has a diameter of about 36.5 mm, the third electrode 163 has a diameter of about 33.2 mm, the fourth electrode 164 has a diameter of about 30.3 mm, the fifth electrode 165 has a diameter of about 27.6 mm, the sixth electrode 166 has a diameter of about 25.2 mm, the seventh electrode 167 has a diameter of about 23.0 mm, the eighth electrode 168 has a diameter of about 20.9 mm, the ninth electrode 169 has a diameter of about 19.1 mm, the tenth electrode 170 has a diameter of about 17.4 mm, the eleventh electrode 171 has a diameter of about 15.9 mm, the twelfth electrode 172 has a diameter of about 14.5 mm, the thirteenth electrode 173 has a diameter of about 13.2 mm, the fourteenth electrode 174 has a diameter of about 12.0 mm, the fifteenth electrode 175 has a diameter of about 11.0 mm, the last smallest ring electrode 176 has a diameter of about 10 mm, or a combination thereof.

Figure 5:
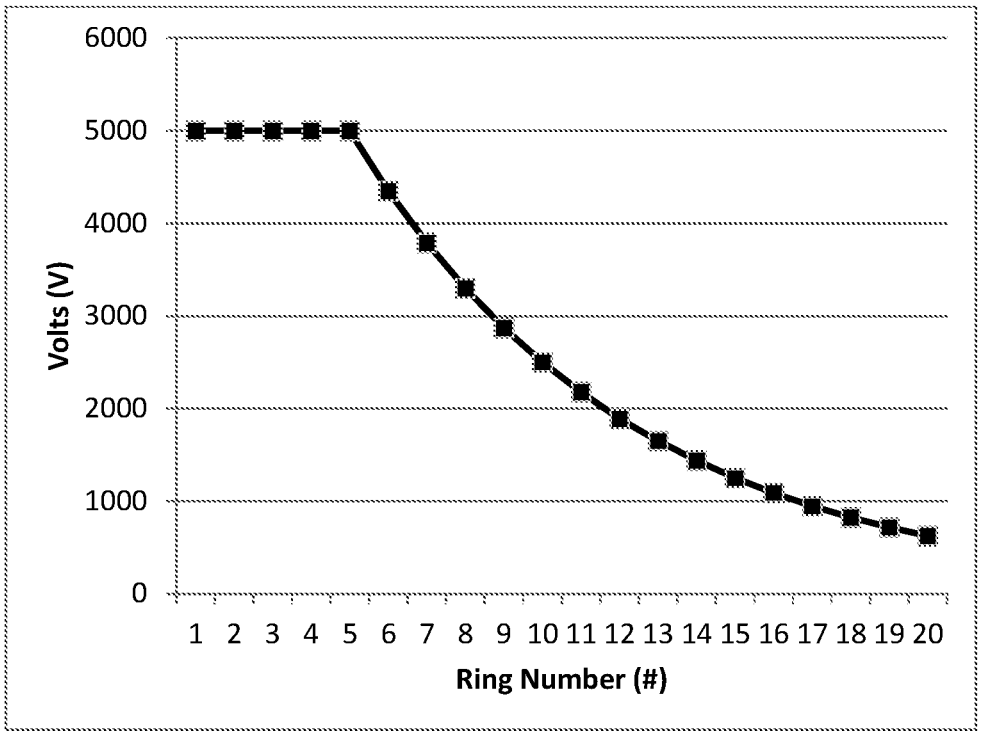
FIG. 5 is a graph of the ring voltages in an exemplary atmospheric pressure ion guide having a multi-ring electrode structure with twenty rings. The voltages (V) are plotted as a function of the ring number going from the larger opening to the smaller opening.

Each of the ring electrodes in the series of ring electrodes 160 can have a voltage that decreases going from the first largest electrode 161 to the last smallest electrode 167 and/or going from the larger opening 110 to the smaller opening 120. In some embodiments the decrease in voltage is exponential. The first largest ring electrode 161 can have a voltage of about 2000 V to 10000 V, about 2000 V to 9000 V, about 3000 V to 9000 V, about 3000 V to 7000 V, about 3000V to 6000 V, or about 5000 V. The voltage can be a DC voltage. The last smallest ring electrode 176 can have a voltage of about 200 V to 1000 V, about 200 V to 800 V, about 400 V to 800 V, or about 625 V. The voltage can be a DC voltage. In some embodiments in the series of ring electrodes 160 the first largest electrode 161 has a voltage of about 5000 V, the second electrode 162 has a voltage of about 4350 V, the third electrode 163 has a voltage of about 3800 V, the fourth electrode 164 has a voltage of about 3300 V, the fifth electrode 165 has a voltage of about 2900 V, the sixth electrode 166 has a voltage of about 2500 V, the seventh electrode 167 has a voltage of about 2200 V, the eighth electrode 168 has a voltage of about 1900 V, the ninth electrode 169 has a voltage of about 1700 V, the tenth electrode 170 has a voltage of about 1400 V, the eleventh electrode 171 has a voltage of about 1300 V, the twelfth electrode 172 has a voltage of about 1100 V, the thirteenth electrode 173 has a voltage of about 950 V, the fourteenth electrode 174 has a voltage of about 830 V, the fifteenth electrode 175 has a voltage of about 720 V, the last smallest ring electrode 176 has a voltage of about 630 V, or a combination thereof. The voltage can be a DC voltage. In some embodiments, each of the rings in the multi-ring electrode structure 140 can have a voltage according to the voltages in FIG. 5.

The multi-ring electrode structure 140 can include one or more additional ring electrodes 180. The additional ring electrodes 180 can be before the first largest electrode 161, after the last smallest electrode 176, or both. The additional ring electrodes 180 can be before the first largest electrode 161, between the series of ring electrodes 160 and the first larger opening 110, and/or between the first largest electrode 161 and the larger opening 110. In these embodiments the additional ring electrodes 180 can have about the same diameter as the first largest electrode 161 and/or about the same voltage as the first largest electrode 161. The additional ring electrodes 180 can have a diameter of about 20 mm to 200 mm, about 20 mm to 150 mm, about 20 mm to 120 mm, about 20 mm to 100 mm, about 20 mm to 80 mm, about 30 mm to 80 mm, about 30 mm to 60 mm, or about 40 mm. The additional ring electrodes 180 can have a voltage of about 2000 V to 10000 V, about 2000 V to 9000 V, about 3000 V to 9000 V, about 3000 V to 7000 V, about 3000V to 6000 V, or about 5000 V. The voltage can be a DC voltage. The additional ring electrodes 180 can be after the last smallest electrode 176, between the series of ring electrodes 160 and the smaller opening 120, and/or between the last smallest electrode 176 and the second smaller opening 120. In these embodiments the additional ring electrodes 180 can have about the same diameter as the last smallest electrode 176 and/or about the same voltage as the last smallest electrode 176. The additional ring electrodes 180 can have a diameter of about 2 mm to 40 mm, about 2 mm to 30 mm, about 2 mm to 20 mm, about 4 mm to 20 mm, about 5 mm to 15 mm, or about 10 mm. The additional ring electrodes 180 can have a voltage of about 200 V to 1000 V, about 200 V to 800 V, about 400 V to 800 V, or about 625 V. The voltage can be a DC voltage.

Figure 6:
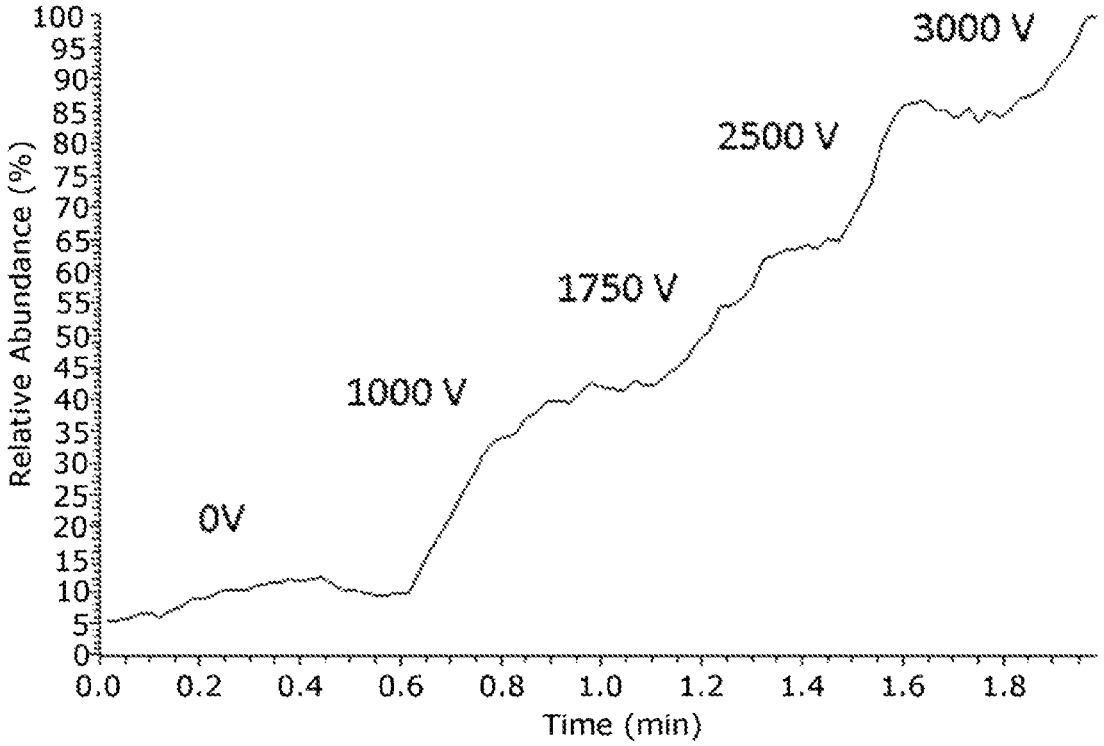
FIG. 6 is a graph of the ion count at the detector as a function of the total voltage applied to the multi-ring electrode structure.

As depicted in FIG. 3, the multi-ring electrode structure 140 can focus ions 190 from an ion source (not pictured). The ions 190 can be injected at a first density in a first space 191 inside the multi-ring electrode structure 140 near the larger opening 110. The ions 190 can travel within the interior space 192 of the multi-ring electrode structure 140 to a second space 193 inside the multi-ring electrode structure 140 at or near the smaller opening 120. The ions 190 can exit through the smaller opening 120 at a second density larger than the first density. This can lead to an increased signal and increased measured ion count relative to the signal or ion count under the same conditions except without applying a voltage to the multi-ring electrode structure. In some embodiments the ion count is about 2, 5, 10, 15, 20, 30, 40, 50 or more times larger than the ion count obtained under the otherwise same conditions except with no voltage applied to the multi-ring electrode structure. As depicted in FIG. 6, enhancements in the ion count can be as high as a factor of 20 at a voltage of 3000 V on the multi-ring electrode structure.

Methods of Using an Atmospheric Pressure Ion Guide

The atmospheric pressure ion guides provided herein can be used to focus a plurality of different ions from different ion sources. Methods of focusing the plurality of ions can include, for example, injecting the ions at a first density at or near the larger opening of an atmospheric pressure ion guide. The ions can travel along the length of the multi-electrode ion structure and exit through the smaller opening with a second density larger than the first density. Although the atmospheric pressure ion guide can be used at a variety of pressures to focus ions, in particular embodiments the pressure is about 1 atm. The pressure can be for instance about 2.0 atm, 1.6 atm, 1.4 atm, 1.2, atm, 1.1 atm, 1.0 atm, 0.9 atm, or less.

A variety of ion sources can be used to generate the plurality of ions. The ion source can be an electrospray ionization (ESI) source, an atmospheric pressure photoionization ("APPI") source, an atmospheric pressure chemical ionization ("APCI") source, an atmospheric pressure matrix assisted laser desorption ionization ("AP-MALDI") source, an atmospheric pressure desorption/ionization on silicon ("AP-DIOS") source, a thermospray ionization source, an atmospheric sampling glow discharge ionization ("APGDI") source, a sonicspray ionization source, or a combination thereof.

The ions injected from the ion source can travel along the length of the multi-ring electrode structure. The ions can be subjected to the focusing potential created by the DC voltage from the series of ring electrodes. The ion can travel along the length of the multi-ring electrode structure without significant changes in the linear velocity. For example, the ions can be injected having a first linear velocity and exit through the smaller opening at a second velocity that differs from the first velocity by about 20%, 15%, 10%, 8%, 6%, 4%, 3%, 2%, 1%, 0.1%, or less. The ions can exit through the smaller opening at a second density larger than the first density, e.g. In some embodiments the focusing results in an increase in the ion count or signal at the detector that is about 2, 5, 10, 15, 20, 30, 40, 50 or more times larger than the ion count obtained under the otherwise same conditions except with no voltage applied to the multi-ring electrode structure.

The methods provided herein can be used to inject the ions from the ion source into an ion detection device. The injection can include injecting the ions through an ion transfer assembly. The ion detection device can be an ion mobility spectrometer, a mass spectrometer, or a combination thereof. Using the atmospheric pressure ion guide, the ion detection device can produce a signal that is about 1-50 times, about 2-50 times, about 5-50 times, about 5-40 times, about 5-30 times, about 5-20 times, or about 10-20 times larger than a second signal produced by the same ion detection device and using the otherwise same method except for not focusing the ions with the atmospheric pressure ion guide prior to injection into the ion detection device.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Figure 7:
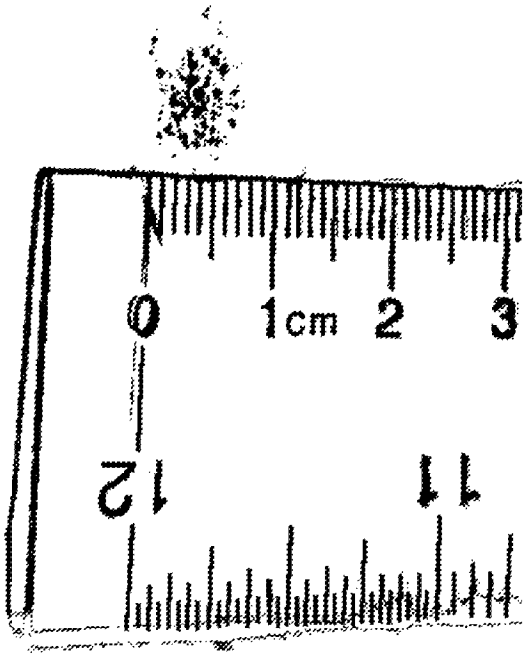
FIG. 7 depicts a picture of an aluminum foil used as a target and demonstrating focusing of an ion beam to a diameter of 7 mm with high ion intensities.

In order to evaluate the actual focusing effect of the ion guide, experiments were conducted using aluminum foil as a target. The foil was suspended at the end of the ion guide, and several parameters were tested. These experiments also served to validate the model used to simulate the ion trajectories. Under certain optimized conditions, the ion beam was focused to a diameter of 7 mm. In addition, after about 5 min, holes began to be burned through the foil, indicating a high concentration of ions. The holes burned in the foil are depicted in FIG. 7 demonstrating a focusing to a diameter of about 7 mm.

It should be emphasized that the above-described embodiments of the present disclosure are merely possible examples of implementations, and are set forth only for a clear understanding of the principles of the disclosure. Many variations and modifications may be made to the above-described embodiments of the disclosure without departing substantially from the spirit and principles of the disclosure. All such modifications and variations are intended to be included herein within the scope of this disclosure.

We claim:

1. An atmospheric pressure ion guide comprising:

a larger opening;

a smaller opening smaller in diameter than the larger opening; and a multi-ring electrode structure connecting the larger opening to the smaller opening and having a series of ring electrodes decreasing in diameter going from the larger opening to the smaller opening, each ring electrode in the series having a voltage and wherein the voltage of each electrode decreases exponentially going from the larger opening to the smaller opening.

2. The atmospheric pressure ion guide of claim 1, wherein the diameter of the ring electrodes in the series decreases exponentially going from the larger opening to the smaller opening.

3. The atmospheric pressure ion guide of claim 1, wherein the ring electrodes comprise a material selected from the group consisting of stainless steel, brass, copper, platinum, titanium, tantalum, and alloys thereof.

4. The atmospheric pressure ion guide of claim 1, wherein the largest ring electrode in the series has a diameter of 20 mm to 80 mm.

5. The atmospheric pressure ion guide of claim 1, wherein the smallest ring electrode in the series has a diameter of 2 mm to 20 mm.

6. The atmospheric pressure ion guide of claim 1, wherein the largest ring electrode in the series has a voltage of 3000 V to 6000 V.

7. The atmospheric pressure ion guide of claim 1, wherein the smallest ring electrode in the series has a voltage of 400 V to 800 V.

8. The atmospheric pressure ion guide of claim 1, wherein the series of ring electrodes has from 12 rings to 25 rings.

9. The atmospheric pressure ion guide of claim 1, wherein the voltage on each electrode is a DC voltage.

10. The atmospheric pressure ion guide of claim 1, further comprising one or more additional rings.

11. The atmospheric pressure ion guide of claim 10, wherein the additional rings are between the multi-ring electrode structure and the first larger opening.

12. The atmospheric pressure ion guide of claim 1, further comprising a housing having the first larger opening and the second smaller opening and containing the multi-ring electrode structure.

13. The atmospheric pressure ion guide of claim 12, wherein the housing comprises a thermosetting polymer material selected from the group consisting of polyethylene, polymethylmethacrylate, polyurethane, polysulfone, polyetherimide, polyimide, ultra-high molecular weight polyethylene (UHMWPE), cross-linked UHMWPE and members of the polyaryletherketone (PAEK) family such as polyetheretherketone (PEEK), carbon-reinforced PEEK, and polyetherketoneketone (PEKK).

14. A method of focusing a plurality of ions from an ion source, the method comprising injecting the ions at a first density at or near the larger opening of the atmospheric pressure ion guide of claim 1, wherein the ions travel along a length of the multi-ring electrode structure and exit through the smaller opening with a second density larger than the first density.

15. The method of claim 14, wherein the pressure within the atmospheric pressure ion guide is 0.2 atm to 2 atm.

16. The method of claim 14, wherein the ions have a first velocity when injected at or near the larger opening and a second velocity when exiting through the smaller opening, wherein the second velocity differs from the first velocity by less than 10%.

17. A method of injecting a plurality of ions from an ion source into an ion detection device, the method comprising focusing the ions according to the method of claim 14, and injecting the ions exiting through the smaller opening into the ion detection device.

18. The method of claim 17, wherein the ions exiting the smaller opening are injected into the ion detection device through an ion transfer assembly.

19. The method of claim 17, wherein the ion detection device is an ion mobility spectrometer, a mass spectrometer, or a combination thereof.

20. The method of claim 17, wherein the ion detection device produces a signal that is 5-20 times larger than a second signal produced by the same ion detection device and using the otherwise same method except for not focusing the ions prior to injection into the ion detection device.

21. The method of claim 17, wherein the signal is at least 5 times larger than a signal obtained under the otherwise same conditions except without applying a voltage to the atmospheric pressure ion guide.

* * * * *